US005474118A

United States Patent [19]

Hoffman

[11] Patent Number: 5,474,118

[45] Date of Patent: Dec. 12, 1995

[54] REINFORCED ROLL-TYPE SHUTTERS

[76] Inventor: Robert E. Hoffman, 5618 Riviera Dr., Coral Gables, Fla. 33146

[21] Appl. No.: 251,291

[22] Filed: May 31, 1994

[51] Int. Cl.[6] ..... E06B 3/06

[52] U.S. Cl. ..... 160/235; 160/133

[58] Field of Search ..... 160/235, 236, 160/133

[56] References Cited

U.S. PATENT DOCUMENTS

| | | | |
|---|---|---|---|
| 3,359,594 | 12/1967 | Pastoor | 160/235 X |
| 4,771,816 | 9/1988 | Clay, Jr. | 160/235 |

FOREIGN PATENT DOCUMENTS

| | | | |
|---|---|---|---|
| 94345 | 11/1983 | European Pat. Off. | 160/236 |
| 2428732 | 2/1980 | France | 160/236 |
| 2001209 | 7/1971 | Germany | 160/236 |
| 3335134 | 4/1985 | Germany | 160/236 |

*Primary Examiner*—Blair M. Johnson
*Attorney, Agent, or Firm*—Harness Dickey & Pierce

[57] ABSTRACT

A roll-type shutter is formed of a number of horizontally elongated shutters, arranged one above the other, hingedly connected together along their adjacent edges for rolling the shutter up or extending it downwardly to form a panel. Each shutter is provided with an upper and lower cavity or channel within which a separate connector member is inserted. The connector members in each cavity are provided with generally L-shaped or hook-like internal portions which engage correspondingly shaped projections formed integrally within the interior of the respective channels so that the connectors are snugly fitted within and engaged against the interior walls of their channels. Each connector has an outer, that is, an upwardly or downwardly, respectively, arranged bent hook portion for engaging the corresponding hook portion of the next connector. The separate connectors extend substantially the full length of each of the slats and reinforce and rigidify the upper and lower edges of each of the slats. Since the slats are narrow, in effect, the shutter panel is divided with a series of horizontal lines of stiffening or reinforcement, which are relatively close together, formed by the connectors so as to resist penetration of the panel by forcefully applied objects.

12 Claims, 2 Drawing Sheets

REINFORCED ROLL-TYPE SHUTTTERS

BACKGROUND OF THE INVENTION

This invention relates to a roll-type shutter having slats which are reinforced and rigidified to resist penetration by forcefully applied objects, such as flying debris propelled by high velocity winds.

Conventional roll-type shutters are made of numerous, narrow, thin, elongated slats which typically are formed of extruded aluminum or plastic. The shutters are aligned from edge to edge, one above the other and are interconnected by a suitable hinging arrangement. A conventional form of hinging arrangement involves the formation of a downwardly directed hook formed on the upper edge of the slat and an upwardly bent hook arrangement formed on the lower edge of the slat for interconnecting the upper edge of one slat to the lower edge of the next higher slat.

Conventional roll type shutters are used to close window openings and doorway openings in buildings. Conventionally, such roll-type shutters overlay doors or windows so as to provide security closures to protect against unauthorized entry and alternatively, to protect against damage due to flying objects. In some instances, a roll-type shutter may be used as a door or a door-like panel.

Such shutters are commonly used in hurricane areas for storm protection. In those areas, when heavy winds blow, such as during a hurricane or the like, it is common to apply the shutters over windows and doors by unrolling the shutters. Thus, debris which may be blown about by high winds, are deflected from piercing doors or windows and causing building damage thereby. In addition, such shutters protect against manual forceful entry such as by unlawfully breaking a window or door.

Because conventional shutters are formed of relatively lightweight, thin slats, the strength or resistance of the shutters against penetration is limited. The resistance of the slats to penetration or breakage due to forceful impacts can be increased by increasing the weight and by using stronger materials than typical extruded aluminum or extruded plastic. However, that results in substantially increased costs, less sightly appearances and heavier constructions which ordinarily would not be suitable for smaller buildings, such as dwellings. Hence, it is desirable to make available a lightweight, architecturally and visually attractive roll-type shutter formed of conventional appearing slats, which shutter may be rolled up or down for storage or use as desired, but which has the strength to resist substantial impacts.

SUMMARY OF THE INVENTION

This invention relates to a roll-type shutter formed of a large number of thin, horizontally elongated, narrow slats which may be formed of a lightweight, extruded material such as aluminum or plastic. The slats are hingedly secured together edge to edge so that when unrolled, they form a panel for covering a doorway or window area or a similar type opening in a building. Each slat is provided with upper and lower edge channels which receive upper and lower connector members respectively. These connector members are shaped and sized to fit within and snugly engage interior pockets formed within the respective channels and to extend outwardly of the channels to the extent necessary to provide hook-like engaging elements. Thus, each connector member serves the functions of hooking or connecting to the next member of the next slot and, simultaneously, to stiffen or rigidify and reinforce its corresponding slat edge. The result is that each edge of each slat is reinforced by an internal stiffening strip, that is, by the connector.

Since each slat is relatively narrow, in the vertical direction, the overall open shutter panel, in effect, has a series of horizontal lines which are closely spaced together, i.e., along each slat edge, which function as if they were reinforcing bars in a barred closure. With this construction, impacts by wind hurled objects or manually applied impacts, such as by a thrown object or by a hammer or the like, are resisted. Consequently, penetration or destruction of the shutter panel is avoided which, correspondingly, avoids penetration of the building and destruction of or unwanted access to, the interior of the building.

One object of this invention is to provide a simplified system for reinforcing and rigidifying relatively lightweight slats which form a roll-type shutter so as to strengthen the panel formed by the shutter without substantially changing the visual appearance of the shutter and without the necessity of utilizing relatively heavy, strong, expensive materials for the shutter slats.

Another object of this invention is to provide a horizontal grid or bar-like structure, which is concealed in or forms a part of a conventional appearing roll-type shutter. The reinforcing means additionally functions as hinge elements for interconnecting the shutter slats.

Still another object of this invention is to provide a conventional appearing shutter construction which is used for dwellings, commercial establishments and the like, which can be used for storm protection and for increased security against unwanted entry, which is relatively inexpensive but which provides a substantially increased protection against forcible impacts which might otherwise penetrate or severely damage a conventional slat type shutter panel.

These and other objects and advantages of this invention will become apparent upon reading the following description, of which the attached drawings form a part.

DETAILED DESCRIPTION

Figure 1:
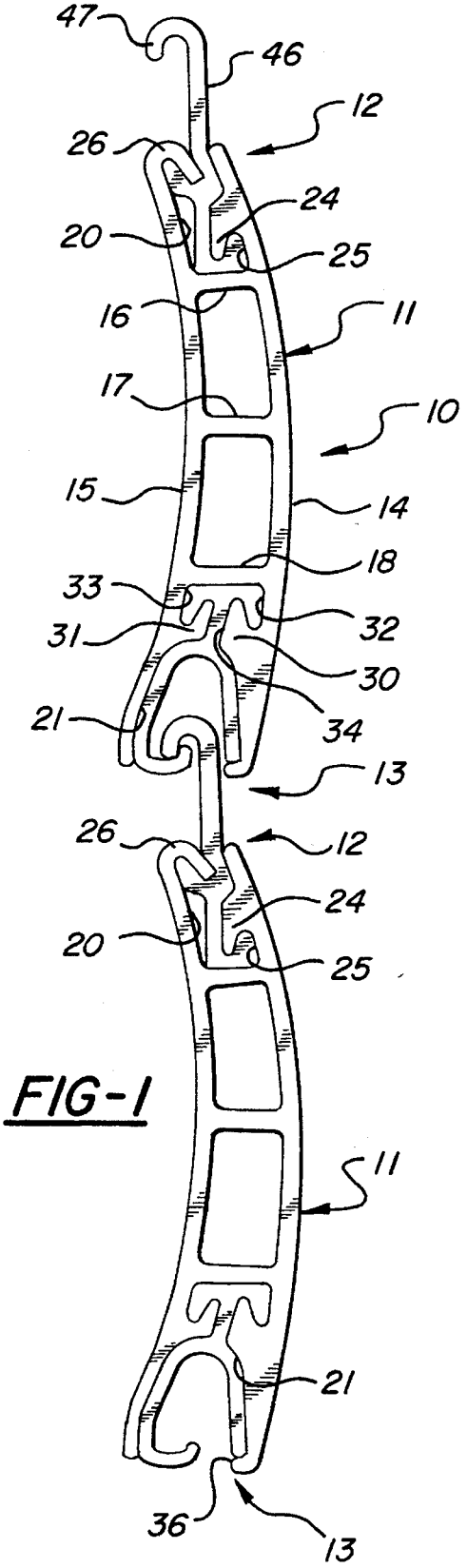
FIG. 1 illustrates a side elevational view of two slats hingedly interconnected and vertically suspended to form a portion of a shutter panel.

Referring to the drawings, the roll-type shutter 10 is formed of numerous slats 11. Each of these slats are preferably formed of relatively thin, extruded aluminum or plastic and are narrow in the vertical direction, and horizontally elongated. The sizes and shapes of such slats are conventional. By way of example, a slat may be on the order of 2 inches in height and one-half inch in thickness and of a horizontal length which may be a number of feet, such as, for example, four feet to cover a window opening.

These slats are substantially identical in a particular shutter. Thus, they may be curved somewhat for appearance and strength and, typically are colored to match the particular decor of the dwelling or structure upon which they are attached. Such slat type shutters are commonly used in warm areas, such as Florida, for security protection as well as storm protection and, therefore, are intended to blend into the decor of the structure upon which they are mounted, particularly so that when they are rolled up they are unobtrusive.

Each slat has an upper edge 12, a lower edge 13, and a pair of spaced apart walls which form a forward wall or face 14 and a rear wall or face 15. The two walls may be interconnected by transverse ribs as, for example, upper transverse rib 16, center rib 17, and lower transverse rib 18. The ribs and walls are integral. With this construction, the slats are hollow.

The upper edge 12 of each slat is provided with an upwardly opening, upward channel 20. Similarly, the lower edge 13 of each slat is provided with a lower, downwardly opening channel 21. The upper channel has a base which is defined by the upper transverse rib 16. Just above that base, an L-shaped projection or flange 24 is formed integral with the forward wall 14. The projection or flange is roughly L-shaped, as seen in view of FIG. 1 so that it has two legs, one of which is integral with the wall and the other of which extends downwardly toward the base 16 to provide an L-shaped cavity or pockets 25 within the channel 20.

The opposite, upper edge of the wall 15, is bent down into a curved hook-like configuration 26.

The lower channel 21, whose base is defined by the lower transverse rib 18, is preferably provided with two projections or flanges. That is, a front projection 30 is formed integral with the forward wall 14 and a rear projection 31 is formed integral with the rear wall 15. Each of these projections are roughly L-shaped in end view or cross-section so that they provide an L-shaped front pocket 32 and an aligned L-shaped rear pocket 33. The two pockets form the head of a T-shape whose stem 34 is the space between the two projections 30 and 31, located roughly at the center line of the channel 21.

The lower free edge of the channel is provided with an inwardly extending front edge bead 36 which runs the length of the channel.

As mentioned, the slats are preferably formed by a conventional extrusion process and are decoratively colored and formed of lengths corresponding to the widths of the openings or other areas upon which the shutters are to be applied. Thus, the sizes and shapes of the slats may vary considerably, depending upon the appearance and coverage needed for a particular shutter.

Figure 2:
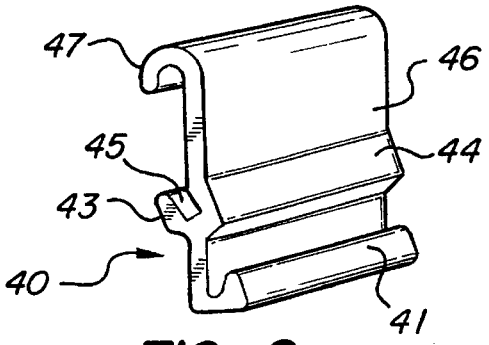
FIG. 2 is a fragmentary, perspective view of an upper connector strip.
Figure 3:
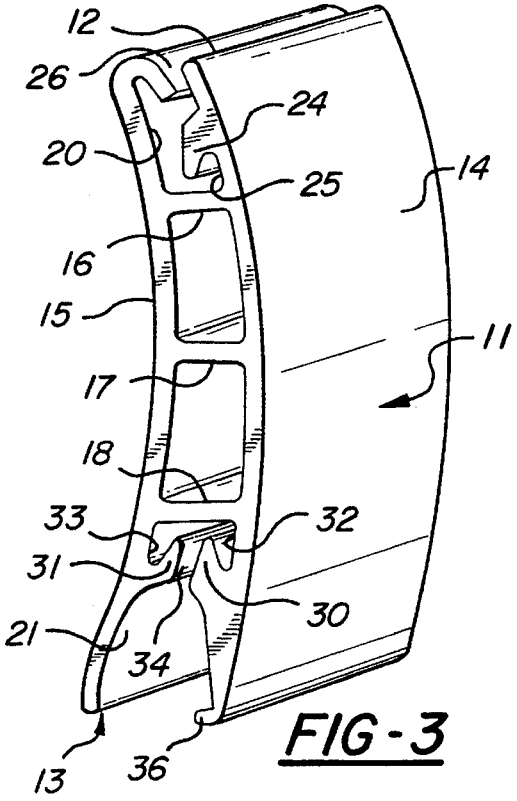
FIG. 3 is a fragmentary, perspective view of the extruded slat, per se.
Figure 4:
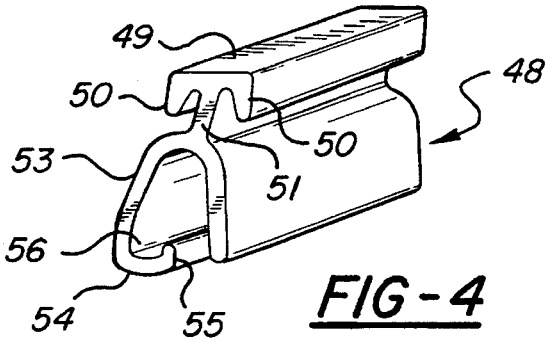
FIG. 4 is a fragmentary, perspective view of the lower connector.
Figure 5:
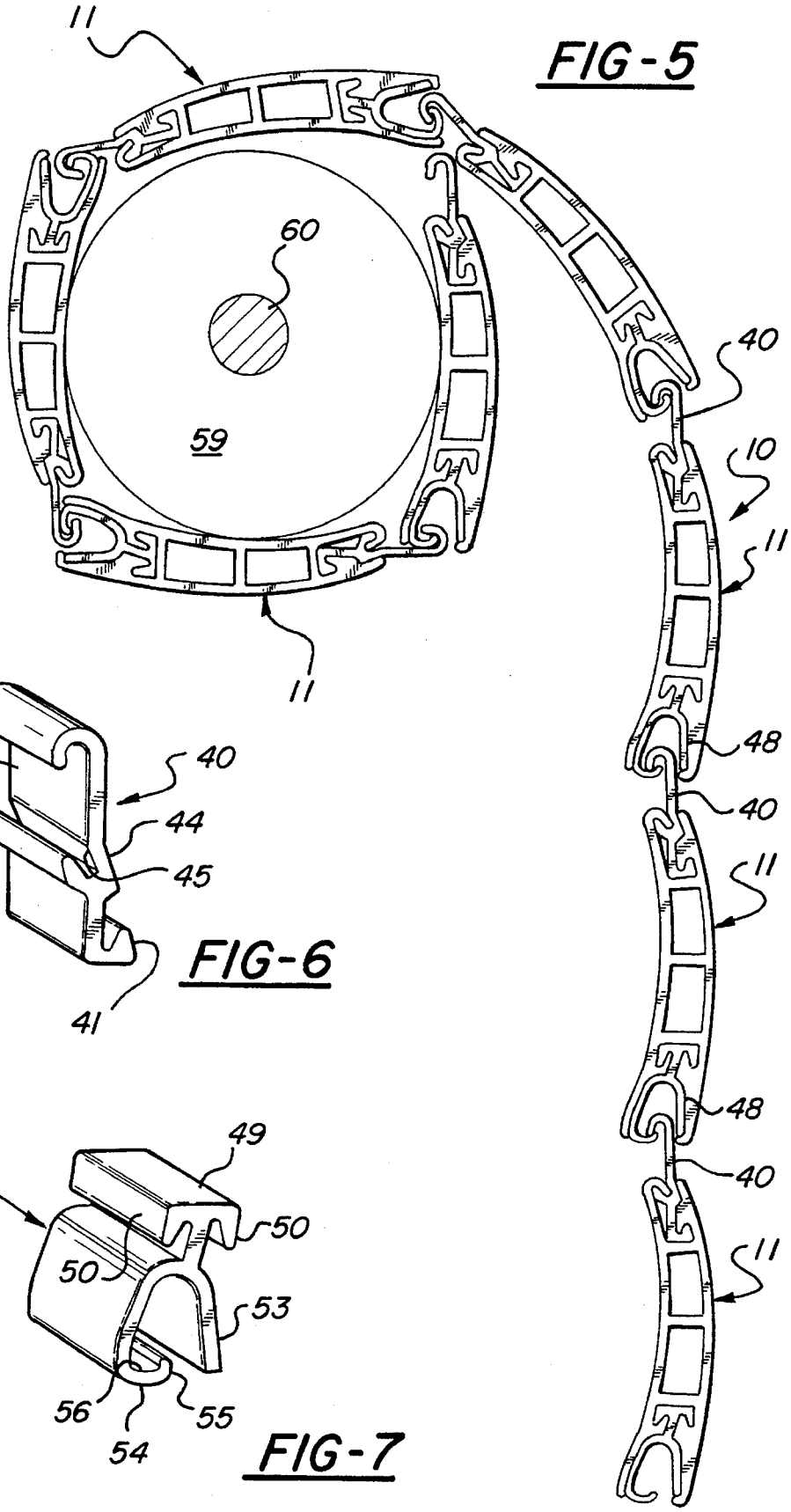
FIG. 5 is an end view of a shutter which is partially rolled up.
Figure 6:
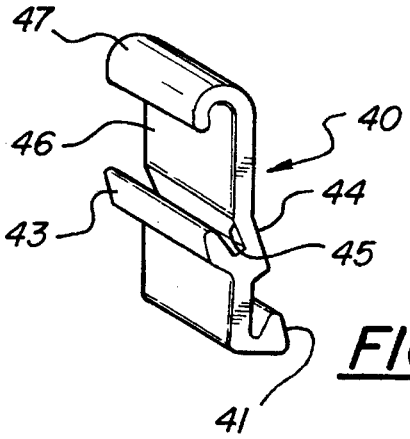
FIG. 6 is a perspective, end view of the upper connector similar to FIG. 2, but shown from the opposite side.
Figure 7:
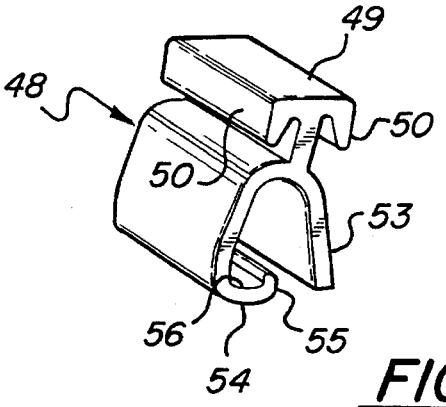
FIG. 7 is a opposite end, perspective fragmentary view of the lower connector illustrated in FIG. 4.

The adjacent edges of the slats are interconnected by a hinge-like construction formed of a pair of connectors which also function as reinforcing rods or strips. Thus, an upper connector 40 is provided in each of the upper channels 20. The upper connector is an elongated, extruded strip made, for example, of an aluminum or steel material which preferably is of a stronger material then that used for the slats. As shown, for example, in FIGS. 2 and 6, the upper connector has a lower part which is L-shaped so that the part 41 snugly fits into the cavity or pocket 25 in its respective slat. The connector may be slid endwise into the channel so that its part 41 is relatively tightly received within the pocket 25.

The center portion of the connector is provided with an integral, upwardly extending flange 43 adjacent an offset portion 44 to provide a groove 45. The groove 45 receives the bent down edge 26 of the slat so that the flange 43 and the hook-like edge 26, which are arranged preferably in engagement, form a double thick reinforcing strip.

The upper connector is also provided with an upwardly extending extension strip 46 which terminates at its upper end with a bent hook portion 47.

The lower connector 48, is shaped to fit within the lower channel 21. Thus, it is formed with an integral T-shaped head 49 whose side edges are formed with beads 50 so that the head and beads snugly fit within the pockets 32 and 33 in the interior of the lower panel. The head is connected by a central stem portion 51 which extends snugly between the adjacent projections 30 and 31 of the lower channel. The stem is integral with a lower, inverted, U-shaped strip 53 which snugly fits within and preferably engages the interior wall surfaces forming the lower channel. An inwardly bent flange 54, terminating in an upwardly bent edge bead 55, is formed on one side of the U-shaped strip. This forms a hook-like portion which receives and, thus, connects with the bent hook 47 of the upper connector of the next lower slat.

In constructing a shutter, slat extrusions are cut to the required lengths and similarly, upper and lower connectors are cut to the lengths corresponding to the slats. The connectors are then slid endwise into the upper and lower channels of the slats. Then, the connectors are then slid endwise into the upper and lower channels of the slats. Then, the connectors are hingedly engaged, by slipping the bent hook part 47 of each upper connector into the lower hook portion 56 formed by the inwardly bent flange 54 at edge bead 55 of the lower connectors.

The uppermost slat is connected by a suitable mechanical connection to a drum or core 59 having a central axle 60 for rotating the drum and, thereby, winding or rolling up the shutter and, conversely, for rolling down the shutter into its panel forming position. The formation of the drum and axle and the mechanism needed for rolling the shutter are conventional and, therefore, a description is not included.

The connectors, in essence, form rigid reinforcing bars extending horizontally across an opening covered by the shutter, while simultaneously interconnecting each of the shutters to the next one. Thus, an impact to the shutter, such as caused by a thrown object or a man applied object, is absorbed and resisted by these horizontal bar-type protective strips which are concealed within the upper and lower edges of the slats. The pocket and the flange or leg configuration of the connectors increase the rigidity and strength of the joints formed by the connectors and the interior surfaces of the respective channels and channel forming walls. Thus, the otherwise relatively lightweight, thin and somewhat fragile shutters are greatly rigidified and reinforced by this connector arrangement and the configuration of the connectors.

This invention may be further developed within the scope of the following claims.

Accordingly, having disclosed an operative embodiment of this invention I now claim:

1. A reinforced roll-type shutter formed of a number of substantially identical, narrow, relatively thin, elongated slats which are normally horizontally arranged and located one above another, edge to edge, to form a substantially planar, vertical panel, and with the slats each having a first longitudinal edge and a second longitudinal edge, with said edges being respectively hingedly connected to the second and first edges of the next adjacent slat so that the shutter may be rolled up or down, and with a channel formed in each of the first and second edges of each slat, with each channel having a base and opposing sidewalls and opening at its respective slat edge;

a roughly L-shaped in cross-section strip interrelate formed on at least one side wall of each of the channels, with the strip having a leg portion which is integral with its respective channel side wall and extends toward the opposite side wall of its channel and a leg portion which extends toward its channel base, to form a roughly L-shaped, in cross-section inner pocket in cooperation with the adjacent base and side wall areas of its channel;

a first and a second connector member, each positioned within a first and second channel of each of the slats, with each connector member having an inner portion formed in a generally hook-like cross-sectional shape engaged with the strip and closely fitted within the pocket of its respective channel and having an outer portion engaged with a wall portion of its channel and terminating in a generally hook-bent portion which is shaped to engage the hook-bent portion on the connector member of its next adjacent slat edge for hingedly connecting the slats together;

whereby the connector members reinforce and rigidify the edge areas of the channels of the respective slats along substantially the full lengths of the slats to thereby resist penetration of the shutter panel by forcefully applied objects.

2. A reinforced roll-type shutter as defined in claim 1, and including a second strip integrally formed on the opposite wall of at least one of the channels of each slat, with said second strip being substantially a mirror image of the first mentioned strip to form a second, generally L-shaped in cross-section pocket within its channel, and with the respective connector members having a corresponding second, generally hook-like in cross-section portion closely fitted within said second pocket.

3. A construction as defined in claim 2, and including said two pockets in each slat being generally transversely aligned within their respective channels, relative to the opposed walls of their respective channels, so that the pockets open into each other adjacent the face of their respective channels.

4. A construction as defined in claim 3, and with the ends of one wall of the opposite channel and each slat being bent inwardly towards the base of the channel to provide a hook-like cavity and with the respective connector member, fitted within that cavity having an integral flange which is closely arranged within said cavity so that the cavity forming wall portions and the flange together form a reinforcing strip along the respective edge of their slat.

5. A construction as defined in claim 4, and with the connector members upon which the flanges are formed each having a portion extending outwardly of their respective channels and being bent into said hook-like portion for engaging the next adjacent connector member.

6. A construction as defined in claim 3, and with said connector members first and second portions which fit into said cavities being transversely aligned to form a generally T-shaped cross-section with a stem portion that extends toward the opening of its channel, and with the stem portion arranged between and in substantial contact with the adjacent portions of the legs of the strips, and with the connector member having portions engaging these walls of the channel between said stem and the opening of the channel for rigidify and reinforcing said channel walls.

7. A construction as defined in claim 6, and with said slats being formed of hollow extrusions having opposed walls which form the longitudinal opposed faces of the slat and which are integrally connected together by the bases of said channels.

8. A reinforced roll-type shutter formed of a number of substantially identical, narrow, elongated slats each slat having a pair of opposing side walls joined by upper and lower edges, said slats being normally horizontally arranged and located one above another, edge to edge, to form a substantially vertical panel, and with the slats being hingedly connected together along their adjacent upper and lower edges for rolling the shutter up or down;

each slat having a respective channel opening outwardly along its upper and lower edges forming upper and lower channels, with the channels extending longitudinally along said slat, and being defined by a horizontal base extending transversely of the opposed vertical walls of the respective slats, and channel walls defined by portions of the slat walls, with the channels opening upwardly and downwardly of each slat;

a generally L-shaped projection formed integrally within each of the channels and having a leg integral with the adjacent channel wall and a leg extending towards the base of the channel, but spaced a distance from the base so as to form a roughly L-shaped, in cross-section, pocket within its respective channel;

first and second connector members positioned within each of the upper and lower channels, with each connector member having a roughly L-shaped in cross-section inner portion which is engaged with the channels and closely fitted within the pocket of its respective channel and each connector member having an outer, hook-like shaped portion for engaging the corresponding portion upon the next adjacent connector of the next slat;

with said connector members extending substantially the full lengths of the respective slats and cooperating with the adjacent slat wall and channel walls with which they contact within the channels, to reinforce and rigidify the longitudinal edges of the slats so as to resist penetration of the shutter panel by forcefully applied objects, while providing the hinge structure for rolling up the panels.

9. A construction as defined in claim 8, and wherein the channels formed in the lower edges of the slats are provided with a second integral projection, forming a mirror image of the first mentioned projection so as together form a T-shaped cross-section structure with a space between the projection forming the stem of the T and with the second connector member, that is, the connector member within the lower channels, having correspondingly shaped portions for closely fitting within the generally T-shaped pocket provided by the projections, and having outer portions arranged to engage the inner wall surfaces of their channels, with the outer portion having a bent hook-like formation for engaging the hook-like portion of the next adjacent connect of the next slat.

10. A construction as defined in claim 9, and including said second connector members having a generally U-shaped outer portion for engaging the inner walls of their channels, with one of the legs of said U-shaped portion being bent into the hook-like shaped portion.

11. A construction as defined in claim 10, and wherein the first connector members fitted within the upper channels are provided with an integral, upwardly extending flange and one wall of their respective channels has a corresponding, downwardly bent flange engaged with the flange of said member and with the connector member having an upwardly extending portion, extending outwardly of its channel and bent downwardly into the hook-like shaped portion.

12. A construction defined in claim 9, and including said slats being formed of hollow-extrusions having opposed walls that are integrally connected by the base forming portions of said channels.

* * * * *